US008353334B2

(12) United States Patent
Zhao et al.

(10) Patent No.: US 8,353,334 B2
(45) Date of Patent: Jan. 15, 2013

(54) NANO TUBE LATTICE WICK SYSTEM

(75) Inventors: Yuan Zhao, Thousand Oaks, CA (US); Chung-Lung Chen, Thousand Oaks, CA (US)

(73) Assignee: Teledyne Scientific & Imaging, LLC, Thousand Oaks, CA (US)

( * ) Notice: Subject to any disclaimer, the term of this patent is extended or adjusted under 35 U.S.C. 154(b) by 1237 days.

(21) Appl. No.: 12/163,766

(22) Filed: Jun. 27, 2008

(65) Prior Publication Data

US 2009/0159243 A1 Jun. 25, 2009

Related U.S. Application Data

(63) Continuation-in-part of application No. 11/960,480, filed on Dec. 19, 2007.

(51) Int. Cl.

| | |
|---|---|
| ***F28D 15/00*** | (2006.01) |
| ***B29D 22/00*** | (2006.01) |
| ***B29D 23/00*** | (2006.01) |
| ***B29D 39/00*** | (2006.01) |
| ***H02H 3/00*** | (2006.01) |

(52) U.S. Cl. ..... 165/104.26; 428/36.5; 428/408; 261/99; 977/742

(58) Field of Classification Search ..... 428/408, 428/36.5; 977/742; 165/104.26; 261/99
See application file for complete search history.

(56) References Cited

U.S. PATENT DOCUMENTS

| | | | | |
|---|---|---|---|---|
| 4,106,188 | A | 8/1978 | Sekhon et al. | |
| 4,602,679 | A | 7/1986 | Edelstein et al. | |
| 4,697,205 | A | 9/1987 | Eastman | |
| 5,002,122 | A | 3/1991 | Sarraf et al. | |
| 7,237,337 | B2 | 7/2007 | Yeh et al. | |
| 7,246,655 | B2 | 7/2007 | Mochizuki et al. | |
| 7,694,726 | B2 * | 4/2010 | Chen | 165/104.26 |
| 7,874,347 | B2 * | 1/2011 | Chen | 165/104.26 |
| 8,042,606 | B2 * | 10/2011 | Batty et al. | 165/104.26 |
| 8,235,096 | B1 * | 8/2012 | Mahefkey et al. | 165/104.26 |
| 2005/0058797 | A1 * | 3/2005 | Sen et al. | 428/408 |
| 2005/0269065 | A1 * | 12/2005 | Chen | 165/104.26 |
| 2006/0042786 | A1 * | 3/2006 | Chen | 165/104.26 |
| 2006/0151153 | A1 * | 7/2006 | Chen | 165/104.26 |
| 2006/0233692 | A1 * | 10/2006 | Scaringe et al. | 423/335 |

(Continued)

OTHER PUBLICATIONS

Vadakkan, Unni et al., "A Novel Carbon Nano Tube based Wick Structure for Heat Pipes/Vapor Chambers", Technology and Manufacturing Group, Intel Corporation, 23rd IEEE Semi-Therm Symposium, pp. 102-104 (Mar. 2007).*

(Continued)

*Primary Examiner* — Ljiljana Ciric
(74) *Attorney, Agent, or Firm* — Koppel, Patrick, Heybl & Philpott

(57) ABSTRACT

A lattice wick system that has a plurality of nano tube wicking walls configured to transport liquid through capillary action in a first direction, each set of the plurality of granular wicking walls forming respective vapor vents between them to transport vapor. A plurality of nano tube interconnect wicks embedded between respective pairs of the plurality of nano tube wicking walls transport liquid through capillary action in a second direction substantially perpendicular to the first direction. The nano tube interconnect wicks have substantially the same height as the nano tube wicking walls so that the plurality of nano tube wicking walls and the plurality of nano tube interconnect wicks enable transport of liquid through capillary action in two directions and the plurality of vapor vents transport vapor in a direction orthogonal to the first and second directions.

10 Claims, 7 Drawing Sheets

U.S. PATENT DOCUMENTS

| | | | | |
|---|---|---|---|---|
| 2007/0151708 | A1* | 7/2007 | Touzov | 165/104.26 |
| 2007/0295494 | A1* | 12/2007 | Mayer et al. | 29/890.039 |
| 2008/0075954 | A1* | 3/2008 | Wardle et al. | 977/742 |
| 2008/0210407 | A1* | 9/2008 | Kim et al. | 165/104.26 |
| 2009/0056917 | A1* | 3/2009 | Majumdar et al. | 165/104.26 |
| 2009/0311166 | A1* | 12/2009 | Hart et al. | 977/742 |
| 2010/0084113 | A1* | 4/2010 | Lee | 165/104.26 |
| 2010/0132923 | A1* | 6/2010 | Batty et al. | 165/104.26 |
| 2010/0200199 | A1* | 8/2010 | Habib et al. | 165/104.26 |

OTHER PUBLICATIONS

Peterson, G.A., "*An Introduction to Heat Pipes*", John Wiley & Sons, Inc., Ch 1, p. 1-9; Ch 3, p. 44-49; Ch 4, p. 98-99; Ch 7, p. 241-259 (1994).

Zhao, Y & Chen, C.L., An Experimental Investigation of a High Performance Vapor Chamber for High Heat Flux Applications, Abstract, *ASME Submittal* (Jul. 2007).

Zhao, Yuan and Chen, Chung-Lung, "An Investigation of Evaporation Heat Transfer in Sintered Copper Wicks With Microgrooves", *International Mechanical Engineering Congress and Exposition*, p. 1-5 (Nov. 5, 2006).

Mo, Zhimin, "Nanotube as Integrated Cooling Devices", *ACREO*, p. 1-2 (Dec. 21, 2006) Apr. 24, 2008 <htt://www.acreo.se/templates/Page_3766.aspx>.

Banerjee, Debjyoti, "Nano-devices for enhanced cooling and explosives sensing", *Nanotechnology Now*, p. 1-3 (Mar. 19, 2007) Apr. 24, 2008 <http://www.nanotech-now.com/news.cgi?story_id=21286>.

Banks, Richard, "Nano-tube cooling", *rb.trends Blog Archive*, p. 1-4 (Oct. 3, 2007) Apr. 24, 2008 <http://www.richardbanks.com/trends/?p=7239>.

* cited by examiner

FIG. 3
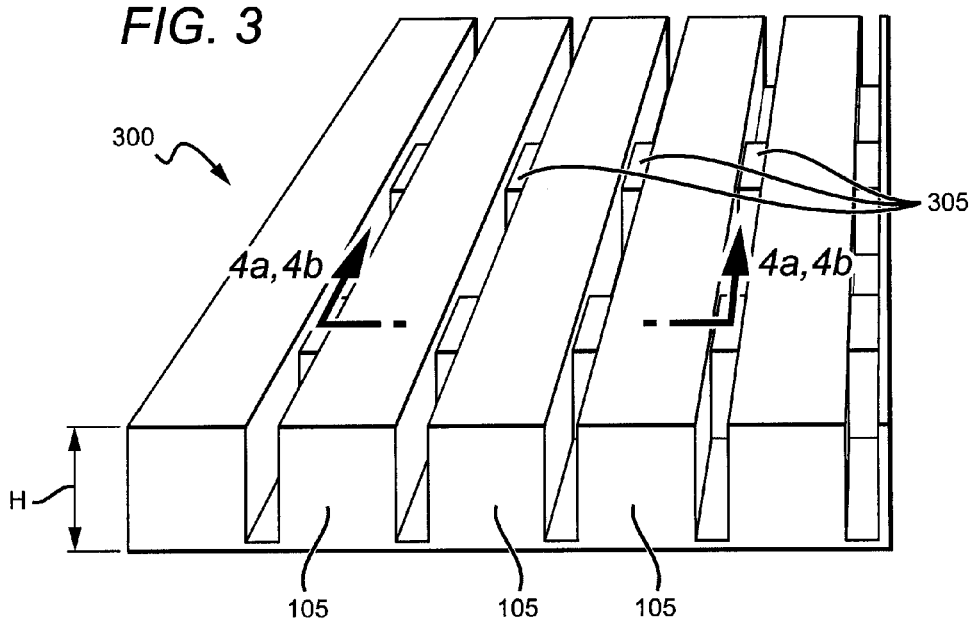
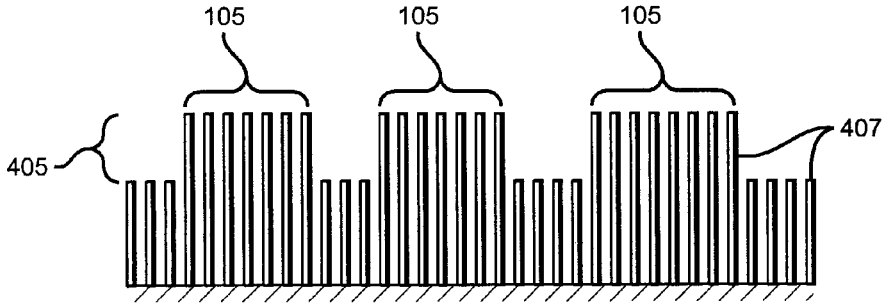
FIG. 4a
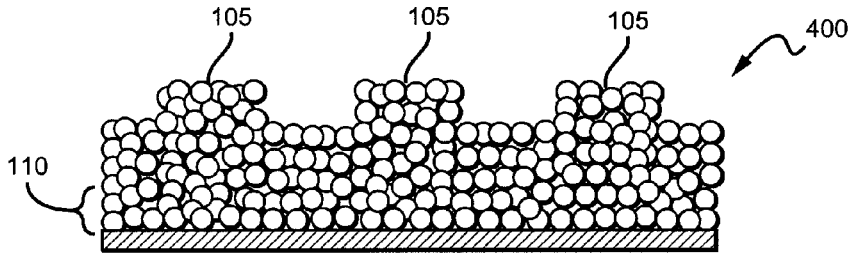
FIG. 4b

FIG. 6
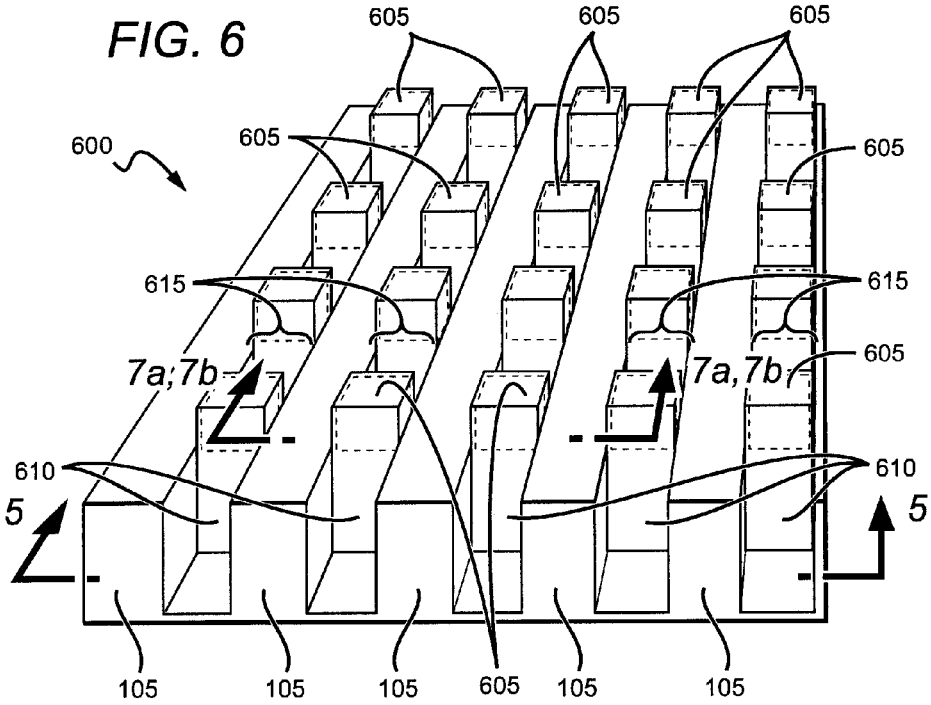
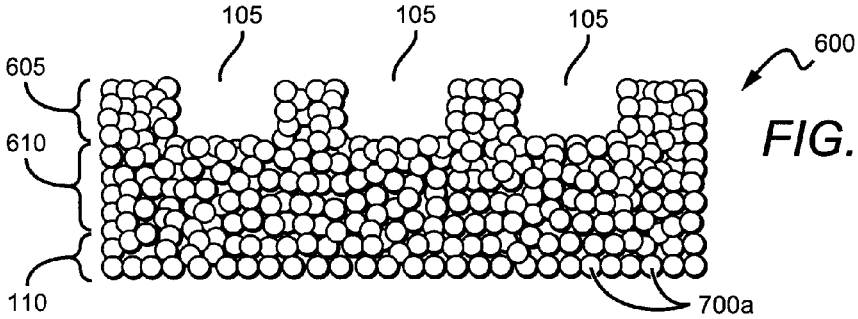
FIG. 7a
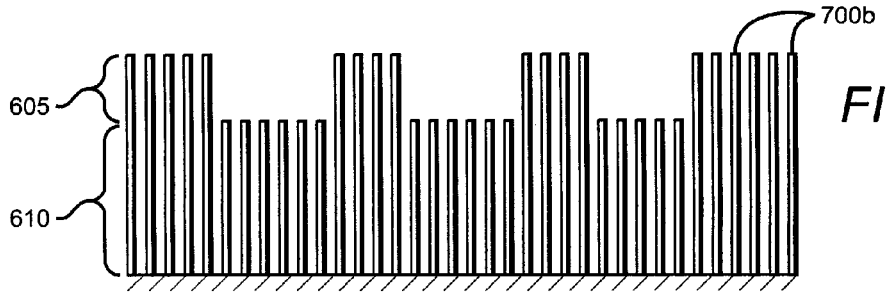
FIG. 7b

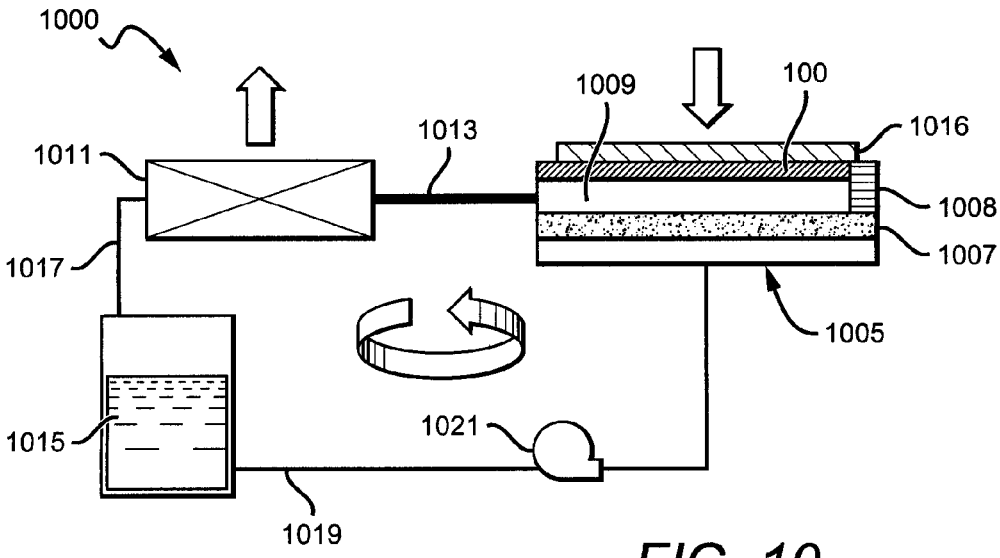
FIG. 10
FIG. 11
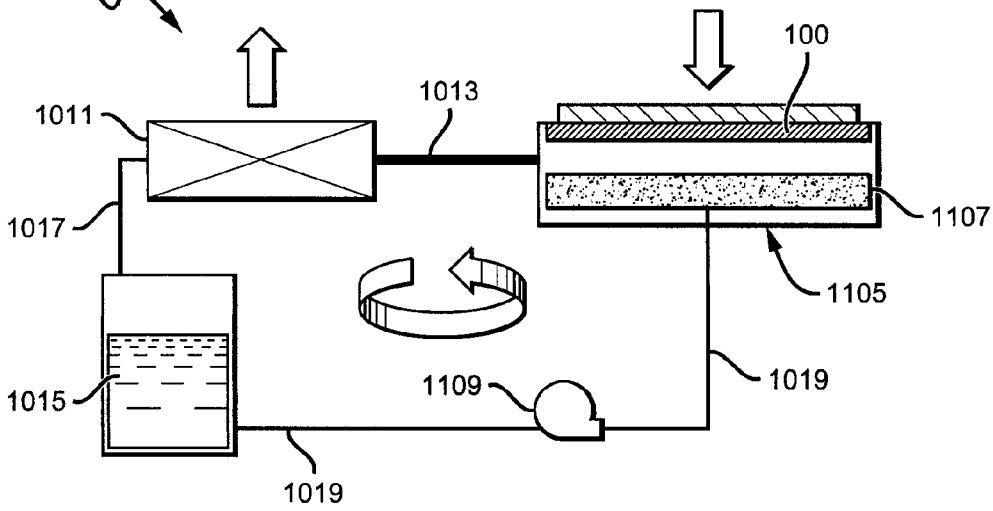

NANO TUBE LATTICE WICK SYSTEM

This application is a continuation-in-part of prior application Ser. No. 11/960,480 filed Dec. 19, 2007.

BACKGROUND OF THE INVENTION

1. Field of the Invention

This invention relates to heat sinks, and particularly to heat pipes.

2. Description of the Related Art

Semiconductor systems such as laser diode arrays, compact motor controllers and high power density electronics increasingly require high-performance heat sinks that typically rely on heat pipe technology to improve their performance. Rotating and revolving heat pipes, micro-heat pipes and variable conductant heat pipes may be used to provide effective conductivity higher than that provided by pure metallic heat sinks. Typical heat pipes that use a two-phase working fluid in an enclosed system consist of a container, a mono-dispersed or bi-dispersed wicking structure disposed on the inside surfaces of the container, and a working fluid. Prior to use, the wick is saturated with the working liquid. When a heat source is applied to one side of the heat pipe (the "contact surface"), the working fluid is heated and a portion of the working fluid in an evaporator region within the heat pipe adjacent the contact surface is vaporized. The vapor is communicated through a vapor space in the heat pipe to a condenser region for condensation and then pumped back towards the contact region using capillary pressure created by the wicking structure. The effective heat conductivity of the vapor space in a vapor chamber can be as high as one hundred times that of solid copper. The wicking structure provides the transport path by which the working fluid is recirculated from the condenser side of the vapor chamber to the evaporator side adjacent the heat source and also facilitates even distribution of the working fluid adjacent the heat source. The critical limiting factors for a heat pipe's maximum heat flux capability are the capillary limit and the boiling limit of the evaporator wick structure. The capillary limit is a parameter that represents the ability of a wick structure to deliver a certain amount of liquid over a set distance and the boiling limit indicates the maximum capacity before vapor is generated at the hot spots blankets the contact surfaces and causes the surface temperature of the heat pipe to increase rapidly.

Two countervailing design considerations dominate the design of the evaporator wicking structure: Liquid transport capability and vapor transport capability. A wicking structure consisting of sintered metallic granules is beneficial to create capillary forces that pump water towards the evaporator region during steady-state operation. However, the granular structure itself obstructs transport of vapor from the evaporator region to the condenser region. Unfortunately, conventional heat pipes can typically tolerate heat fluxes less than 80 W/cm$^2$. This heat flux capacity is too low for high power density electronics that may generate hot spots with local heat fluxes on the order of 100-1000 W/cm$^2$. The heat flux capacity of a heat pipe is mainly determined by the evaporator wick structures. Carbon nano tubes grown in a "forest" structure or grown to form microchannel fins have also been explored for use as evaporator wicking structures. In the case of an evaporator wicking structure formed of microchannel nano tube fins, inner-surfaces between microchannel fins have also been treated with nano tubes to further increase the thermal exchange rate.

A need still exists for a heat pipe with increased capillary pumping pressure with better vapor transport to the condenser to enable higher local heat fluxes.

SUMMARY OF THE INVENTION

A nano tube lattice wick system is disclosed that has, in one embodiment, a plurality of nano tube wicking walls configured to transport liquid through capillary action in a first direction, each set of the plurality of granular wicking walls forming respective vapor vents between them to transport vapor. A plurality of nano tube interconnect wicks embedded between respective pairs of the plurality of nano tube wicking walls transport liquid through capillary action in a second direction substantially perpendicular to the first direction. The nano tube interconnect wicks have substantially the same height as the nano tube wicking walls so that the plurality of nano tube wicking walls and the plurality of nano tube interconnect wicks enable transport of liquid through capillary action in two directions and the plurality of vapor vents transport vapor in a direction orthogonal to the first and second directions.

In another embodiment, a heat pipe includes a nano tube lattice wick structure, that has a plurality of wicking walls spaced in parallel to wick liquid in a first direction, the plurality of wicking walls forming vapor vents between them, a plurality of interconnect wicking walls to wick liquid between adjacent wicking walls in a second direction substantially perpendicular to the first direction. A vapor chamber encompassing the nano tube lattice wick structure, and the vapor chamber has an interior condensation surface and interior evaporator surface so that the plurality of wicking walls and the plurality of interconnect wicking walls are configured to wick liquid in first and second directions and the vapor vents communicate vapor in a direction orthogonal to the first and second directions.

BRIEF DESCRIPTION OF THE DRAWINGS

The components in the figures are not necessary to scale, emphasis instead being placed upon illustrating the principals of the invention. Like reference numerals designate corresponding parts throughout the different views.

FIG. 3 is a perspective view that has, in one embodiment, non-staggered interconnect wicks formed perpendicular to wicking walls, with said interconnect wicks having a height less than said wicking walls;

FIG. 4*a* is a cross-section view of the embodiment shown in FIG. 3 along the line 4*a*-4*a* illustrating wicks formed of sintered particles;

FIG. 4*b* is a cross-section view of the embodiment shown in FIG. 3 along the line 4*b*-4*b* illustrating wicks formed of nano tubes;

FIG. 6 is a perspective view of a wicking structure that has an array of wicking supports extending away from the wicking structure;

FIG. 7*a* is a cross-section view of the embodiment shown in FIG. 6 along the line 7*a*-7*a* illustrating wicking supports and a wicking structure formed of sintered particles;

FIG. 7*b* is a cross-section view of the embodiment shown in FIG. 6 along the line 7*b*-7*b* illustrating wicking supports and a wicking structure formed of nano tubes;

FIG. 10 is a system diagram illustrating one embodiment of a nano tube lattice wick system that has a vapor chamber connected to a condenser to establish a loop heat pipe system.

FIG. 11 is a system diagram illustrating one embodiment of a nano tube lattice wick system that has a vapor chamber provided with a spray nozzle array and connected to a pump and condenser to establish a hybrid loop heat pipe/spray cooling system.

DETAILED DESCRIPTION OF THE INVENTION

A lattice wick, in accordance with one embodiment, includes a series of nano tube wicking walls configured to transport liquid using capillary pumping action in a first direction, with spaces between the wicking walls establishing vapor vents between them. Nano tube interconnect wicks are embedded between pairs of the wicking walls to transport liquid through capillary pumping action in a second direction. The vapor vents receive vapor migrating out of the nano tube wicking walls and interconnect wicks for transport in a direction orthogonal to the first and second directions. The system of nano tube wicking walls and nano tube interconnect wicks enable transport of liquid through capillary action in two different directions, with the vapor vents transporting vapor in third direction orthogonal to the first and second directions. In one embodiment, the lattice wick preferably includes an array of pillars, alternatively called wicking supports, extending from the interconnect wicks to support a condenser internal surface and to wick liquid in the direction orthogonal to the first and second directions for transport to the interconnect wicks and wicking walls. Although the embodiments are described as transporting liquid and vapor in vector directions, it is appreciated that such descriptions are intended to indicate average bulk flow migration directions of liquid and/or vapor. The combination of wicking walls, interconnect wicks and vapor vents establish a system that allows vapor to escape from a heated spot without significantly affecting the capacity of the lattice wick to deliver liquid to the hot spot.

Figure 1:
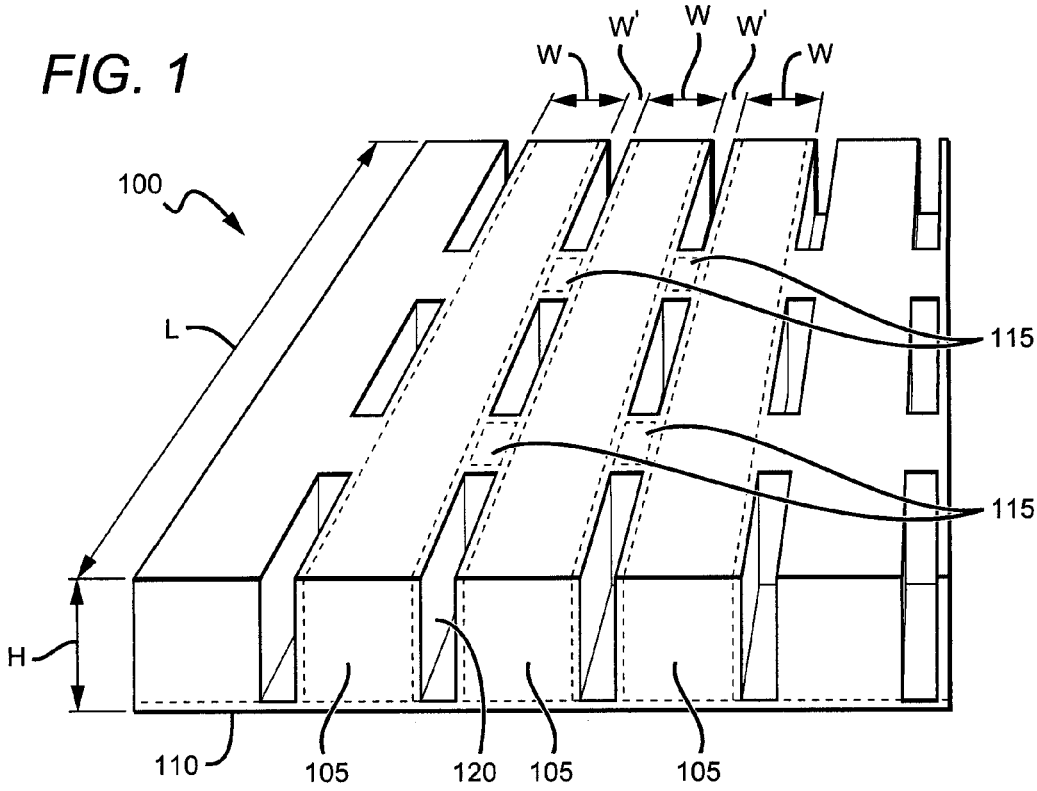
FIG. 1 is a perspective view of a lattice wick that has, in one embodiment, non-staggered interconnect wicks formed perpendicular to parallel-spaced wicking walls.

In one embodiment illustrated in FIG. 1, a wick structure 100 is formed in a fingered pattern with each finger defining parallel wicking walls 105 formed on a wick structure base 110 to communicate a working liquid in a first direction. Length L of each wicking wall 105 is far greater than the width W of each wicking wall 105. The wicking walls 105 are preferably formed in parallel with one another to facilitate their manufacture. Interconnect wicks 115 are formed between and embedded with wicking walls 105 to communicate the working liquid between the wicking walls 105 in a second direction perpendicular to the first direction. The wicking walls 105 and interconnect wicks 115 establish vapor vents 120 between them to transport vapor in a direction orthogonal to the first and second directions during operation.

Although the wicking walls 105 and wick structure base 110 are illustrated in FIG. 1 as solid, they are formed of either an open porous structure of packed particles, such as sintered copper particles that each has a nominal diameter of 50 microns, or preferably of substantially aligned carbon nano tubes grown on a silicon base, to enable capillary pumping pressure when introduced to a working fluid.

In the preferred carbon nano tube embodiment, the working fluid is preferably water, but may be other liquids such as NH3, dielectric fluids (such as FC72 or HFE7100), and refrigerants such as HFC-134a, HCFC-22. The ratio of wicking walls 105 to interconnect wicks 115 may also be changed to increase the fluid carrying capacity in the first and second directions, respectively.

In the sintered copper particles embodiment, other particle materials may also be used, such as stainless steel, aluminum, carbon steel or other solids with reduced reactance with the chosen working fluid. In this embodiment, the working fluid is preferably purified water, although other liquids may be used such as such as acetone or methanol. Acceptable working fluids for aluminum particles include ammonia, acetone or various freons; for stainless steel, working fluids include water, ammonia or acetone; and for carbon steel, working fluids include Naphthalene or Toluene.

In one carbon nano tube wick structure designed to provide an enlarged heat flux capacity and improved phase change heat transfer performance, with purified water as a working fluid, the various elements of the wick structure have the approximate length, widths and heights listed in Table 1. Preferably, the base layer of 110 is omitted to simplify the fabrication process.

TABLE 1

| | Length | Width | Height |
|---|---|---|---|
| Wicking walls 105 | 6 cm | 150 microns | 250 microns |
| Interconnect wicks 115 | 125 microns | 125 microns | 250 microns |
| Vents 120 | 300 microns | 125 microns (W') | 250 microns |

The dimensions of the various elements may vary. For example, vapor vent width W' can range from a millimeter to as small as 10 microns. The width W of each wicking wall 105 is preferably in a range from couple of microns to hundreds of microns. Although the wicking walls 105 are described as having a uniform width, they may be formed with a non-uniform width in a non-linear pattern or may have a cross section that is not rectangular, such as a square or other cross section. When carbon nano tubes form the latticed wick, the tubes may have a diameter in the range of tens of nano meters to hundreds of nano meters.

Figure 2:
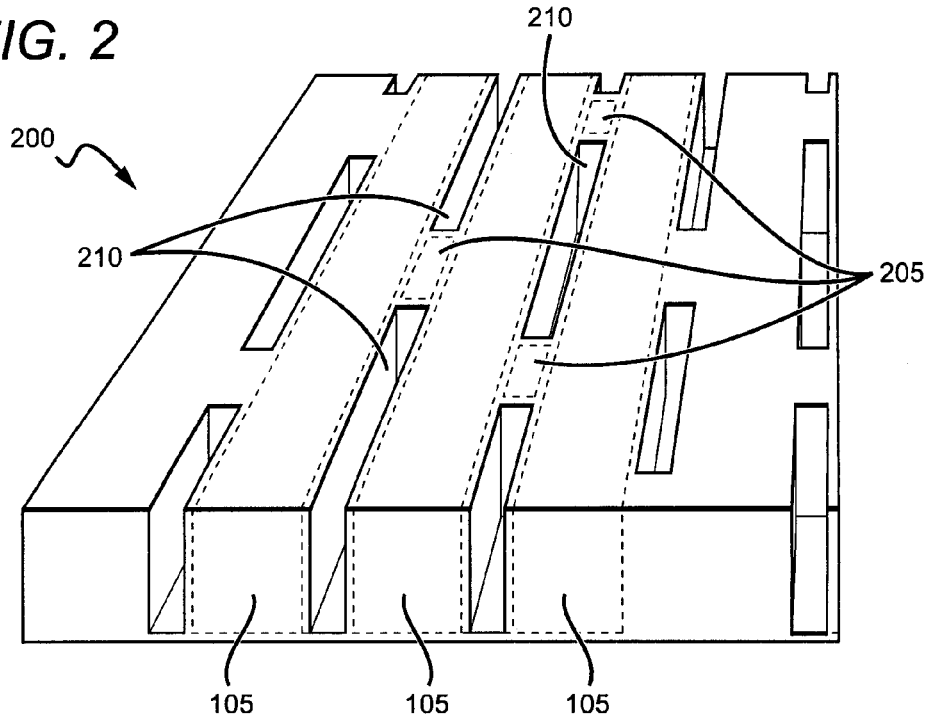
FIG. 2 is a perspective view, in one embodiment, of a lattice wick that has staggered interconnect wicks formed perpendicular to wicking walls spaced in parallel.

FIG. 2 illustrates one embodiment of a lattice wick 200 that has interconnect wicks 205 formed in a staggered position between and embedded with wicking walls 105 to communicate the working fluid between the wicking walls 105 in the second direction perpendicular to the first direction. As in the embodiment illustrated in FIG. 1, the wicking walls 105 and interconnect wicks 205 establish vapor vents 210 between them to transport vapor in a direction orthogonal to the first and second directions during operation. As described above for FIG. 1, the wicking walls 105 and interconnect wicks 205 may be formed of nano tubes, preferably carbon nano tubes that each have a diameter of tens of nano meters, to enable significantly higher capillary pumping pressure in comparison to conventional wicks, when introduced to a working fluid, to handle high gravity applications.

FIG. 3 illustrates one embodiment that has a wick structure 300 with interconnect wicks 305 which differ in height from wicking walls 105. In the illustrated embodiment, interconnect wicks 305 have a height which is less than the height H of the wicking walls 105. The interconnect wicks 305 may also be staggered in relation to themselves or be formed with differing heights.

The embodiments illustrated in FIGS. 1-3 are preferably formed of carbon nano tubes; however, the structures may be formed from the same or different materials to provide differing manufacturing techniques and thermal conduction properties. Also, the height H of the wicking walls 105 may be of non-uniform height.

FIG. 4*a* illustrates a cross section view along the line 4*a*-4*a* in FIG. 3, showing one embodiment that has the wicking structure formed from nano tubes. Wicking walls 105 and wicking supports 405 are preferably formed from carbon nano tubes that each have a nominal diameter of tens of nano meters (for example, 20 nm) to provide a suitable capillary limit and resulting liquid pumping action. To increase the capillary limit and resulting liquid pumping force between the condenser to evaporator regions, a smaller spacing between nano tubes would be used. Increasing the spacing between adjacent nano tubes would result in a reduced capillary limit but would decrease vapor pressure drop between the condenser and evaporator regions thus allowing freer movement of vapor to the condenser.

FIG. 4*b* illustrates a cross section view along the line 4*b*-4*b* in FIG. 3, showing one embodiment that has the wicking structure formed from sintered particles. In this embodiment, wicking walls 105, wick structure base 110 and wicking supports 405 are formed from sintered copper particles that each have a nominal diameter of 50 microns to provide a suitable capillary limit and resulting liquid pumping action. Similar to the embodiment illustrated in FIG. 4*a*, a smaller spacing between sintered copper particles would increase the capillary limit and liquid pumping force between the condenser to evaporator regions. Increasing the spacing between adjacent copper particles (such as using packed, sintered copper particles having a diameter greater than 50 microns) would result in a reduced capillary limit but would decrease vapor pressure drop between the condenser and evaporator regions thus allowing freer movement of vapor to the condenser.

Figure 5:
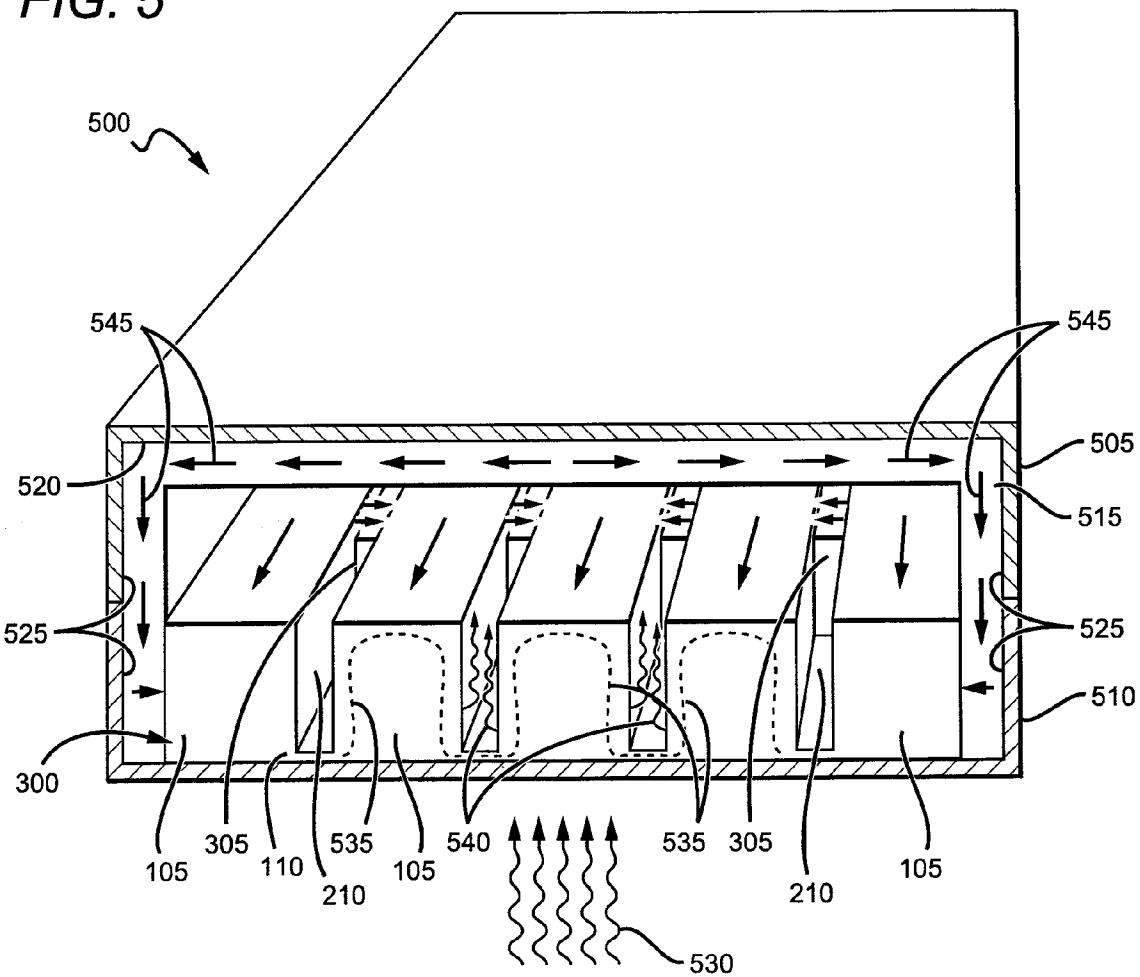
FIG. 5 is a perspective view of one cross-section view of a vapor chamber that has the wick illustrated in FIG. 3 and illustrating vapor and liquid transport during steady-state operation.

FIG. 5 illustrates the wick structure 300 of FIG. 3 seated in upper and lower shells 505, 510. Working fluid (not shown) saturates the wicking walls 105, interconnect wicks 305 and wick structure base 110. A conventional wick 515 is seated on an interior condensation surface (alternatively called the "condenser") portion 520 of the upper shell and on interior vertical faces 525 of the upper and lower shells 505, 510 to establish a heat spreader in the form of vapor chamber 500. The standard wick may be any micro wick, such as that illustrated in U.S. Pat. No. 6,997,245 issued to Lindemuth and such is incorporated by reference. A heat source 530 in thermal communication with one end of the vapor chamber 500 causes the working fluid to heat which causes a small vapor—fluid boundary 535 to form in a portion of the wicking walls 105 adjacent the heat source 530. As vapor 540 escapes from the interior of the wicking walls, it is communicated to the condenser 520, due in part to a pressure gradient existing between the evaporator region and vapor—liquid boundary 535. Upon condensing, the condensed working fluid 545 is captured by the standard wick 515 for transport to wicking walls 105 through interconnect wicks 305 because of capillary pumping action established between the working fluid and sintered particles that preferably comprise the standard wick 515 and that comprise the wicking walls 105 and interconnect wicks 305. The working fluid is transported towards the heat source 530 to replace working fluid vaporized and captured by the vapor vents 210. The heat source 530 may be any heat module that can benefit from the heat sink properties of the vapor chamber 500, such as a laser diode array, a compact motor controller or high power density electronics. The upper and lower metallic shells 505, 510 are coupled together and are each preferably formed of copper, although other materials may be used, such as aluminum, stainless steel, nickel or Refrasil.

FIG. 6 further illustrates a wick structure 600 that uses the wicking walls 105 of FIG. 1, but with a portion of the interconnect wicks formed with a greater height to define an array of wicking supports 605 extending from an upper surface of respective interconnect wicks 610 and away from the interconnect wicks and wicking walls (610, 105). Each interconnect wick 610 preferably has an associated wicking support 605 defined as an extension from it; however, wick structure 600 need not have defined a wicking support 605 for each interconnect wick 610. The wicking supports 605 provide structural support for a condensation surface of a vapor chamber (not shown) and transport working fluid condensed from vapor on the condensation surface to the wicking walls 105 through interconnect wicks 610. Vapor vents 615 are established between respective pairs of wicking walls 105 and opposing interconnect wicks 610.

FIG. 7*a* illustrates a cross section view along the line 7-7 in FIG. 6, showing one embodiment that has the wicking structure formed from sintered particles. The packed, sintered copper particles 700*a* each preferably have a nominal diameter of 50 microns to provide an effective pore radius of approximately 13 microns after sintering. Each wick support 605 extends up from its respective interconnect wick 610 to provide structural support for the condensation surface of the vapor chamber and to transport working fluid to the wicking walls 105.

FIG. 7*b* also illustrates a cross section view along the line 7-7 in FIG. 6, showing one embodiment that has the wicking structure formed from carbon nano tubes. Each nano tube 700*b* preferably has a nominal diameter of tens of nano meters (for example, 20 nm) and a height of 250 microns. Each wick support 605 extends up from its respective interconnect wick 610 to provide structural support for the condensation surface of the vapor chamber and to transport working fluid to the wicking walls 105.

Figure 8:
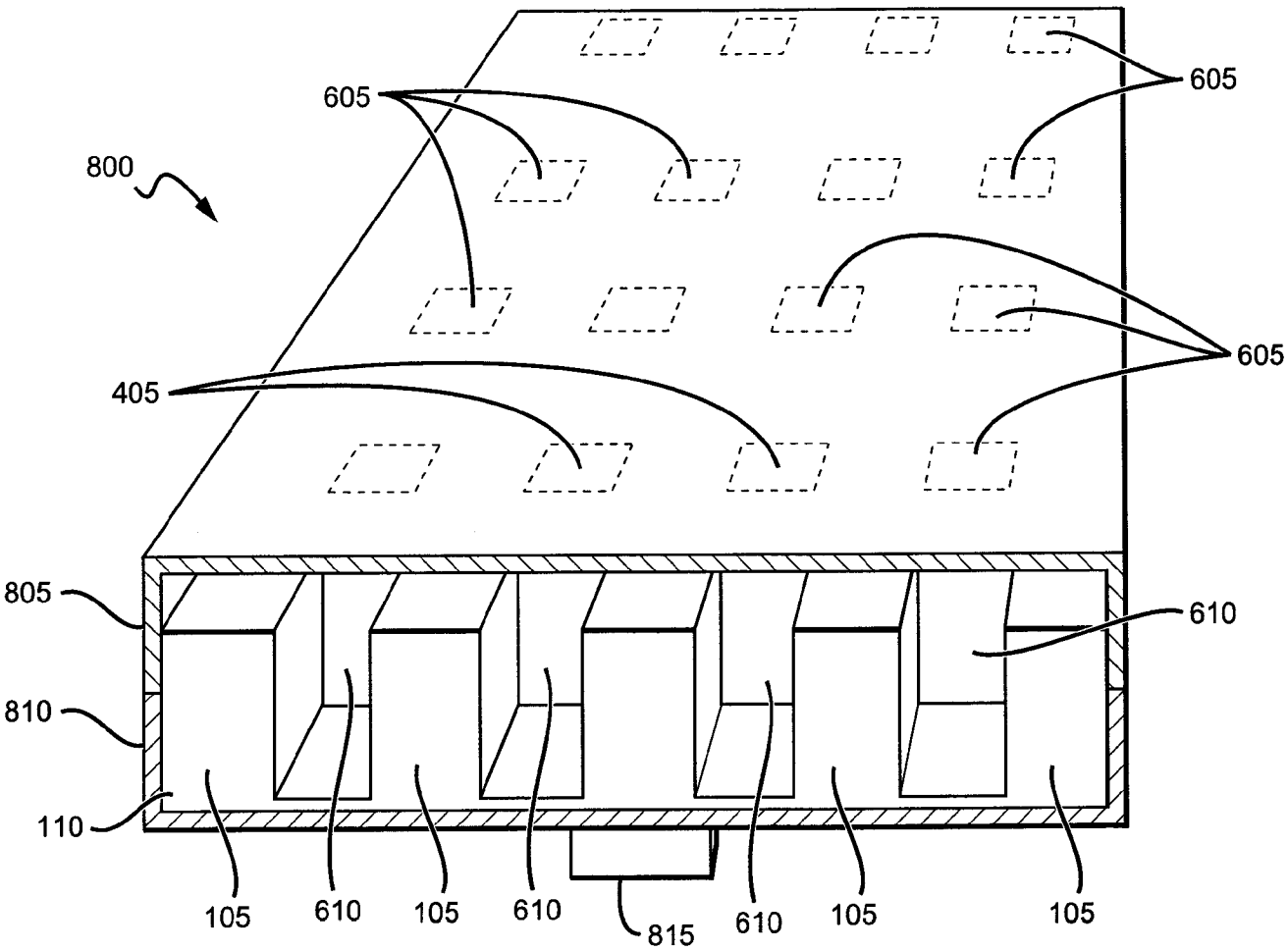
FIG. 8 is a perspective view of one cross-section of a vapor chamber that has the wick illustrated in FIG. 6 disposed within the vapor chamber.

FIG. 8 illustrates the wick structure of FIG. 6 seated in upper and lower shells 805, 810 to establish a vapor chamber 800 upon introduction of a working fluid to saturate the wicking walls 105, interconnect wicks 610 and wick structure base 110. Uppermost faces of wicking supports 605 within the vapor chamber are indicated with dashed lines, with an interior condensation surface (alternatively called the "condenser") portion of the upper shell 805 seated on the uppermost faces of wicking supports 605 for both structural support of the upper shell 805 and so that condensate (working fluid) formed on the condenser is captured by the wicking supports 605. The working fluid is transported to the wicking walls 105 through the interconnect wicks 610 due to capillary pumping action back towards the heat source. The upper and lower metallic shells are coupled together and preferably each formed of copper, although other materials may be used, such as aluminum, stainless steel, nickel or Refrasil. The vapor chamber 800 is in thermal communication with a heat source 815, such as a laser diode array, a high heat flux motor controller, high power density electronics or other heat source that can benefit from the heat sink properties of the vapor chamber 800. The interior surface adjacent the heat source

815 is considered the evaporator, although the vapor-fluid boundary is ideally spaced from the actual evaporator surface during steady-state operation.

Figure 9:
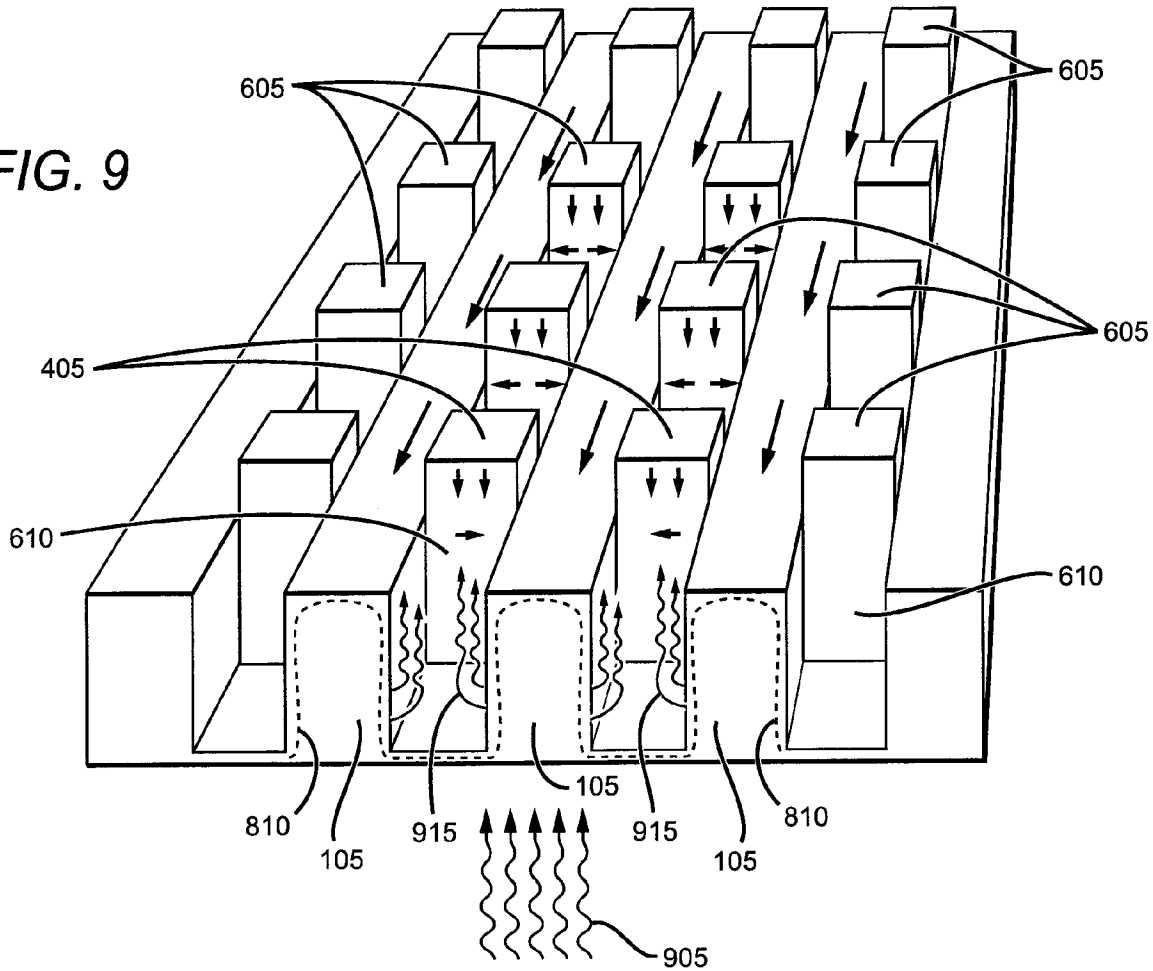
FIG. 9 is a perspective view of the wick illustrated in FIG. 8 with the vapor chamber upper and lower shells removed to better illustrate vapor and fluid flow during steady-state operation.

FIG. 9 shows the flow of liquid and vapor in the vapor chamber illustrated in FIG. 8 during steady-state operation, with the upper and lower shells removed for clarity. As heat 905 is applied to one end of the vapor chamber 800, the working fluid is heated at the evaporator surface adjacent the heat source 905 and a vapor—fluid boundary forms in a portion of the wicking walls 105 as vapor 915 escapes from the interior of the wicking walls 105. The vapor 915 is communicated to the condenser due in part to a pressure gradient existing between the evaporator region and vapor—liquid boundary. Upon condensing, the condensed working fluid is captured by the wicking supports 605 for transport to wicking walls 105 through interconnect wicks 610 due to capillary pumping action established between the working fluid and sintered particles or nano tubes that comprise the wicking supports 605, wicking walls 105 and interconnect wicks 610. The working fluid is transported towards the heat source 905 to replace working fluid vaporized and captured by the vapor vents 615.

FIG. 10 illustrates one embodiment of a circulation system 1000 that uses a nano tube lattice wick in a loop heat pipe system. A vapor chamber 1005 is preferably provided with a conventional wick, such as a mono-dispersed reservoir wick 1007, seated on a condenser internal surface of a vapor chamber 1005. A lattice wick structure 100, such as that illustrated in FIG. 1, is established on an opposing evaporator internal surface of the vapor chamber 1005 and is connected to the reservoir wick 1007 through a side conventional wick 1008 (or an extension of reservoir wick 1007) established on interior vertical faces of the vapor chamber 1005. The reservoir wick 1007, side conventional wick 1008 and lattice wick structure 100 seated in the vapor chamber define a vapor space 1009 that is in vapor communication with a condenser 1011 through a vapor line 1013. A liquid tank 1015 is connected between the condenser 1011 and vapor chamber 1005 through liquid feeding tubes 1017, 1019 to receive condensate from the condenser 1011 for bulk storage prior to the condensate's recirculation to the reservoir wick 1007.

During operation, the circulation system 1000 is first charged with a two-phase working fluid to saturate the reservoir wick 1007 and lattice wick structure 100. A reservoir of working fluid is introduced into liquid tank 1015 and the liquid feeding tube 1019 is primed. As heat Q is introduced to the lattice wick structure 100 by a heat source 1016 in thermal communication with the vapor chamber 1005 on a side adjacent the lattice wick structure 100, vapor migrates through vents (not shown) in the wick structure 100 to the vapor space 1009. The heat source 1016 may be any heat module that can benefit from the heat sink properties of the vapor chamber 1005, such as a laser diode array, a compact motor controller or high power density electronics. Vapor from the vapor space 1009 is drawn through the vapor line 1013 to the condenser 1011 as a result of a pressure differential formed between the vapor space 1009 and the condenser 1011 during operation. Condensate formed in the condenser 1011 is captured and communicated to the liquid tank 1015 through the liquid line 1017 for recirculation to the reservoir wick 1007 through liquid feed tube 1019. A pump 1021 may be provided in line with the liquid line 1019 to aid recirculation of the working fluid from condenser 1011, through the liquid tank 1015 and to the reservoir wick 1007. Liquid is pumped through capillary action through the reservoir wick 1007 up to the lattice wick structure 100 through the side conventional wick 1008 to replace vaporized working fluid.

FIG. 11 illustrates another embodiment of a circulation system 1100 that uses a nano tube lattice wick in a hybrid loop heat pipe/spray cooling system. A vapor chamber 1105 has the lattice wick structure 100 on an interior top surface of the vapor chamber 1105 and a working fluid spray manifold 1107 positioned in complementary opposition to the lattice wick structure 100 to spray working fluid on the lattice wick structure 100 to replace working fluid vaporized during steady state operation. As in the system illustrated in FIG. 10, a condenser 1011 is coupled between a liquid tank 1015 and the vapor chamber 1105, with a vapor line 1013 communicating vapor from the vapor chamber 1105 to the condenser 1011. Condensate created in the condenser 1011 from the vapor is transported to the liquid tank 1015 through liquid line 1017. A pump 1109 is preferably provided between the vapor chamber 1105 and the liquid tank 1015 to create sufficient pressure for transport of the working fluid from the liquid tank 1015, through liquid feeding tube 1019 and through the spray manifold 1107 with sufficient pressure to deliver the lattice wick structure 100 with working fluid. The lattice wick 100 will then redistribute the liquid by capillary forces to cover all areas.

While various implementations of the application have been described, it will be apparent to those of ordinary skill in the art that many more embodiments and implementations are possible that are within the scope of this invention.

We claim:

1. A lattice wick apparatus, comprising:

a plurality of nano tube wicking walls configured to transport liquid through capillary action in a first direction, each set of said plurality of granular wicking walls forming respective vapor vents between them to transport vapor; and a plurality of nano tube interconnect wicks embedded between respective pairs of said plurality of nano tube wicking walls to transport liquid through capillary action in a second direction substantially perpendicular to said first direction;

wherein said plurality of nano tube wicking walls and said plurality of nano tube interconnect wicks enable transport of liquid through capillary action in both said first direction and said second direction and said plurality of vapor vents transport vapor in a direction orthogonal to said first and second directions.

2. The apparatus of claim 1, further comprising:

a monodispersed reservoir wick connected to at least one of said plurality of nano tube wicking walls to receive a reservoir of liquid for supply to said at least one of said plurality of nano tube wicking walls.

3. The apparatus of claim 2, further comprising:

a liquid feeding tube positioned adjacent said monodispersed reservoir to transport liquid to said monodispersed reservoir wick.

4. The apparatus of claim 2, further comprising:

a reservoir trough connected to said monodispersed reservoir wick to receive a reservoir of liquid for transport to said monodispersed reservoir wick.

5. The apparatus of claim 1, wherein at least one of said plurality of nano tube interconnect wicks further comprises:

a nano tube wicking support extending away from said at least one of said plurality of nano tube interconnect wicks to provide lattice wick structure support and liquid transport.

6. The apparatus of claim 1, wherein said plurality of nano tube wicking walls comprise a plurality of carbon nano tubes.

7. The apparatus of claim 1, wherein each of said plurality of nano tube wicking walls have a rectangular cross section.

8. The apparatus of claim 1, further comprising a wick structure base, said wick structure base comprising a plurality of nano tubes, each of said plurality of nano tubes having a height less than and positioned between each of said plurality of nano tube wicking walls and said plurality of nano tube interconnect wicks to receive a thin-film layer of liquid.

9. The apparatus of claim 1, wherein said plurality of nano tube interconnect wicks have substantially the same height as said plurality of nano tube wicking walls.

10. The apparatus of claim 1, wherein the height of said plurality of nano tube interconnect wicks is different from the height of said plurality of nano tube wicking walls.

* * * * *